United States Patent [19]

Beacom, deceased et al.

[11] 4,255,911

[45] Mar. 17, 1981

[54] HELICOPTER ENCLOSURE

[76] Inventors: John M. Beacom, deceased, late of Salix, Iowa; Delia A. Beacom, Executrix, R.R. 1, Salix, Iowa 51052

[21] Appl. No.: 921,303

[22] Filed: Jul. 3, 1978

[51] Int. Cl.[3] ..... E04B 1/346

[52] U.S. Cl. ..... 52/66; 52/69; 52/174

[58] Field of Search ..... 52/174, 64, 66, 69; 244/114

[56] References Cited

U.S. PATENT DOCUMENTS

| | | | |
|---|---|---|---|
| 2,765,499 | 10/1956 | Couse . | |
| 2,969,074 | 1/1961 | Willis . | |
| 2,992,709 | 7/1961 | McIntosh . | |
| 3,034,607 | 5/1962 | Haines, Jr. . | |
| 3,229,649 | 1/1966 | Baker | 52/66 |
| 3,258,886 | 7/1966 | Button . | |
| 3,353,310 | 11/1967 | Ruhle . | |
| 3,353,311 | 11/1967 | McClure et al. . | |

FOREIGN PATENT DOCUMENTS

| | | | |
|---|---|---|---|
| 33585 | 5/1964 | Finland | 52/66 |
| 439577 | 1/1975 | U.S.S.R. | 52/66 |

OTHER PUBLICATIONS

Sales Brochure "Heli Pod", Marine. Aero Corp. 9-2-8-78.

*Primary Examiner*—William F. Pate, III

*Attorney, Agent, or Firm*—Shanley, O'Neil and Baker

[57] ABSTRACT

A helicopter shelter in the form of an elongated generally rectangular building having a floor defining a landing pad and a superstructure including side and end walls extending upwardly from the side and end edges, respectively, of the floor and a roof cooperating with the floor and walls to define a secure, substantially weathertight enclosure. The superstructure is divided substantially along its longitudinal vertical center plane into two complementary half-sections each supported for pivotal movement about longitudinal axis extending adjacent the side edges of the floor between a closed upright position and an open position folded downward and outward. The end wall portions of the respective half-sections of the superstructure fold inward along a diagonal line extending from their lower outside corners to their upper inside corners when the half-sections are pivoted to the open position to facilitate flying onto and off of the landing pad.

8 Claims, 7 Drawing Figures

FIG. 4
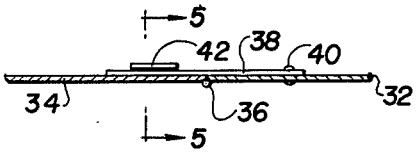
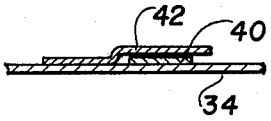
FIG. 5
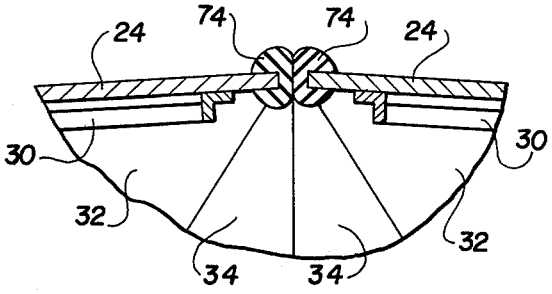
FIG. 6
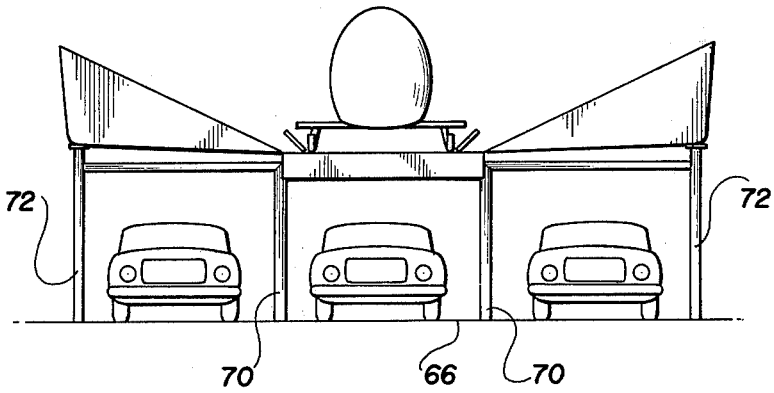
FIG. 7

HELICOPTER ENCLOSURE

BACKGROUND OF THE INVENTION

1. Field of the Invention

This invention relates to aircraft shelters, and more particularly to an improved helicopter shelter which may be opened to permit flying directly into and out of the shelter and closed to provide a compact secure enclosure for the helicopter.

2. Description of the Prior Art

It is well known to provide protective enclosures for individual aircraft, particularly relatively small fixed wing aircraft of the type commonly used by individuals or relatively small groups for private use as opposed to the larger aircraft used, for example, by a major airline. The individual aircraft enclosures, or hangers, frequently have included moveable walls and/or moveable wing enclosures which may be opened to permit parking a plane in the hanger, and subsequently closed around the parked plane to provide the desired shelter. Such single plane enclosures or hangers conventionally employ a fixed roof with at least a portion of the vertical walls also being fixed so that the plane is rolled into and out of the hanger from the same side of the structure.

Aircraft enclosures are known which are constructed of lightweight material and have a configuration generally conforming to the exterior of the plane, the enclosure being divided along the longitudinal center plane and the halves mounted for lateral movement to embrace a parked plane. One such structure is disclosed in U.S. Pat. No. 3,353,310 which describes an enclosure adapted to engage and gain support from the enclosed aircraft to enable the structure to withstand loads from wind, snow or the like.

It is also known to provide collapsible building structures in which at least a part of the walls are hinged together for movement between an expanded or erected position for use and a collapsed or partially collapsed position as for transportation. One such collapsible building structure is illustrated, for example, in U.S. Pat. No. 2,765,499. Despite the collapsible nature of such prior art buildings, substantial preparation is normally required either to collapse or expand the building, and the buildings are not intended to be collapsed and expanded in situ during normal use.

While it has been common practice to provide individual hangers or enclosures for fixed wing aircraft, such storage facilities normally have not been provided for helicopters, particularly at private or small landing sites, with the result that helicopters are normally stored at an airport when not in use. The lack of convenient storage space has resulted in the helicopter losing much of its convenience, and consequently its' use as a simple and readily accessible means for transporting small numbers of people has not met the acceptance originally contemplated for such vehicles.

The lack of convenient and economical storage facilities for helicopters is believed to be at least partially responsible for their failure to meet the anticipated acceptance and use. Due to the rotor structure, relatively large sheds, or hangers have been required and the extent of open space has necessarily made such structures relatively expensive to build. Further, the space required by such storage facilities, in combination with the additional space required for landing and taking off, has made it virtually impossible to provide adequate storage facilities at or near the home of most potential users. Nevertheless, due to the substantial cost of helicopters, most owners are unwilling to allow them to sit in the open when not in use, with the result that the apparatus is stored at the airport and consequently loses much of its convenience.

SUMMARY OF THE INVENTION

In view of the foregoing, it is the primary object of the present invention to provide a convenient and economical, readily accessible shelter for a helicopter.

Another object of the invention is to provide such a shelter which requires minimum space and which may be mounted in various locations including on the ground, rooftops, or supported on columns above driveways or the like.

Another object is to provide such a shelter which also provides a landing pad for the helicopter.

Another object of the invention is to provide such a shelter which is easily installed and which provides a safe landing pad for takeoff and landing of helicopters.

In the attainment of the foregoing and other objects and advantages of the invention, an important feature resides in providing an elongated, generally rectangular housing having a floor structure which acts as a landing pad for the helicopter. The superstructure of the enclosure is divided substantially along the longitudinal vertical center plane, with the opposing half-sections being pivotally mounted on the floor structure, adjacent the side edges thereof, for movement between the upright closed position in which the normally substantially vertical side walls are pivoted to a substantially horizontal position to expose the entire floor for use as a landing pad, with the half-sections of the superstructure being pivoted clear of the path of the rotor of the helicopter during landing or takeoff. The end wall sections of the superstructure are hinged along a diagonal line extending from the upper inner corner to the lower outer corner of the respective sections, with the pivoted portions being moved inwardly and downwardly to provide maximum clearance and thereby permit landing on and taking off from the landing pad in other than a directly vertical path. The half-sections of the enclosure are moved between their closed and open positions by fluid operated piston and cylinder actuating devices which may be provided with fluid pressure by a hand or electrically operated pump.

DESCRIPTION OF THE DRAWINGS

Other objects and advantages of the invention will be apparent from the detailed description contained herein below, taken in conjunction with the drawings, in which:

FIG. 4 is a sectional view taken along line 4—4 of FIG. 3;

FIG. 5 is an enlarged sectional view taken on line 5—5 of FIG. 4;

FIG. 6 is an enlarged fragmentary sectional view showing the joint between the two half-sections of the superstructure of the enclosure; and FIG. 7 is a schematic, front elevation view of an alternate mounting structure for the enclosure.

DESCRIPTION OF THE PREFERRED EMBODIMENTS

Figures 1, 2, 3:
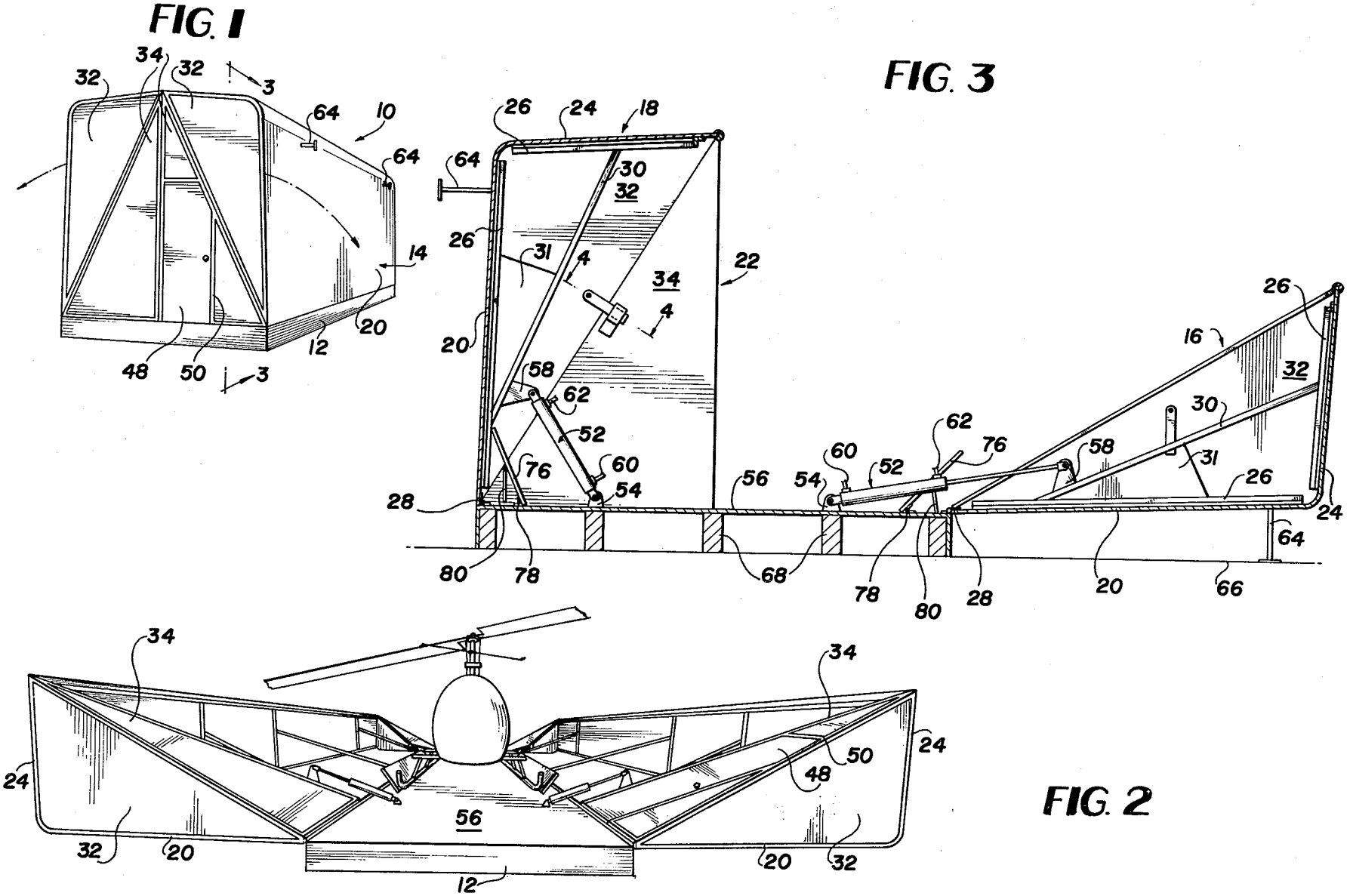
FIG. 1 is an isometric view of a helicopter enclosure embodying the present invention.
FIG. 2 is an enlarged front isometric view of the structure in FIG. 1, showing the enclosure folded open and a helicopter positioned thereon.
FIG. 3 is a vertical sectional view of the helicopter enclosure showing one side of the enclosure in the upright position and the other side in the folded-down position.

Referring now to the drawings, an elongated generally rectangular helicopter enclosure embodying the invention is designated generally by the reference numeral 10. Enclosure 10 includes a base structure 12 defining a landing pad for a helicopter, and an open, shell-like superstructure or housing 14 mounted on and cooperating with base 12 to define an elongated, relatively narrow housing structure having an open, generally unobstructed interior. The housing 14 is divided substantially along its longitudinal vertical center plane into two complementary clam shell-like half sections 16, 18 which can be substantially identical except for an access door which may be provided in one housing section as described hereinbelow. To the extent that the sections 16, 18 are identical, only the section 16 will be described in detail, it being understood that the description applies equally to section 18, and the same reference numerals will be employed to designate corresponding parts of the two housing sections. Thus, housing section 16 includes a generally rectangular side wall 20, opposed end wall assemblies 22 and a top wall or roof panel 24. The side wall 20, end walls 22 and roof panel 24 of each housing section are rigidly assembled and reinforced by structural members such as angles 26 suitably joined into an internal structural framework. Side wall 20 is pivotally supported, by suitable hinges 28, at its lower edge to the side edge of rectangular base 12 for movement between a closed, upright position as shown in FIG. 1 and a lowered, open position shown in FIGS. 2, 3, and 7. A plurality of internal brace members 30 extend between the side wall 20 and roof panel 24, at spaced intervals along the length of the housing 14 to reinforce the roof and provide rigidity to the structure. Gusset plates 31 may also be provided between certain of the braces 30 and side wall 20 as described below.

The end wall 22, are generally rectangular in elevation view and are divided into two substantially triangular-shaped panels hingedly connected along a diagonal line extending from the lower outside corner to the upper inside corner of the respective end wall assemblies. Thus, end wall assemblies 22 comprise an upper triangular panel 32 rigidly joined along its top edge to roof panel 26 and along its outer edge to side wall 20, and a lower triangular panel assembly 34 hingedly joined, as by a piano-hinge 36, to the panel 32.

Triangular panel members 32 and 34 are releasibly retained in a coplanar relation by a retaining latch mechanism illustrated in FIGS. 3, 4, and 5. Thus, an elongated bar member 38 is pivotally connected, as by pin 40, to the rigid panel member 32. Bar 38 has a length sufficient to overlap the piano-hinge joint 36 so that its free end projects in overlying relation with the inner surface of panel member 34 when panels 32 and 24 are in the coplanar relation with the housing in the closed, upright position shown in FIG. 1. A latch retainer 42 in the form of a plate having one end rigidly joined to the inner surface of panel 32 and its other end spaced therefrom is positioned to engage and retain the moveable end of the latch bar 38 in position spanning the hinge joint 36 to releasibly retain the panels 32 and 34 in the coplanar relation. When the superstructure is moved to the open, or lowered position, the respective latch bars 38 can be manually released and swung clear of the hinge joint 36 between the respective panels so that moveable panel 34 may then be swung inwardly and downwardly to the collapsed position shown in FIG. 2. Conversely, when the housing sections are moved to the closed position, the moveable end panel sections will swing, under the influence of gravity, to the coplanar relation so that the latch bar 38 can be readily dropped in place to rigidly retain the two triangular panels in their coplanar relation. If required for additional security, a suitable latch mechanism may also be provided to secure the bottom of the panel to the top surface of the base 12 when the enclosure half sections are in the upright or closed position.

As shown in FIGS. 1 and 2, one of the moveable panel sections 34 is provided with a door 48 supported in a frame structure 50 for movement with the moveable panel between the collapsed and erected position. In the upright or closed position shown in FIG. 1, door 48 may be opened and closed in the normal manner to provide ready access to the interior of the helicopter enclosure. Alternatively, the door 48 may be provided in one of the side walls 20, adjacent one end thereof, with the door 48 being hung to open inwardly to avoid the possibility of damage during raising and lowering of the superstructure housing section.

As best seen in FIG. 3, the housing sections of the superstructure are moved between the raised and lowered positions by double acting hydraulic jacks 52. Preferably two jacks are employed to manipulate each housing section of the superstructure to provide a more uniform control of the raising and lowering operation. Jacks 52 have their cylinder end pivotally connected to a rigid floor bracket 54 projecting upwardly from the horizontal floor surface 56 of base 12 and their piston end pivotally connected to a bracket member 58 rigidly welded to a reinforcing brace 30. Preferably gusset plates 31 are provided between the braces 30 to which the brackets are joined and the wall 20 to provide a more rigid support. Fluid connections 60, 62 are provided at opposed ends of the jack cylinder, with the connections 60, 62 being normally connected to a source of hydraulic pressure fluid through a suitable flexible hose and piping system, not shown. Such hydraulic system is conventional and may be either powered or manually operated, through a suitable valve control, to apply fluid pressure to the inlets 60 or 62 selectively to raise or lower the housing sections.

As shown in FIGS. 1 and 2, a plurality of outwardly projecting support feet 64 may be provided on the side walls 20, adjacent the top thereof, in position to engage a supporting surface (illustrated as the ground surface 66 in FIG. 2) to support the weight of the superstructure housing sections when the helicopter enclosure is opened, thereby relieving the load on the hydraulic jacks 52.

Since the base 12 serves as a landing and takeoff pad for the helicopter, it is provided with a high strength, smooth floor surface 56 disposed over a plurality of rigid support beams 68 to provide a high strength, rigid base. As shown in FIG. 3, the beams 68 may be supported directly upon a smooth surface such as a concrete pad or other suitable surface, or the base may be supported on suitable foundation blocks spaced above the ground surface. Also, as shown in FIG. 7, the entire assembly may also be supported by a plurality of rigid posts or columns 70 over a driveway or the like to thereby enable use of the area beneath the enclosure to further conserve space. Further, the posts 70 may be of a height to support the assembly above an existing structure such as a car port, garage, or the like whose roof structure lacks the strength to support the combined weight of a helicopter and the enclosure structure. If desired, laterally spaced columns or posts 72 may be positioned outboard of the base to provide support for the housing sections of the superstructure in the open position.

As shown in FIG. 6, the roof panels 24 are provided with resilient sealing strip members 74 along their free edges, with the respective sealing strips 74 being in position to abutt one another and provide a substantially weather tight seal when the housing sections are in the closed position.

The embodiment of the invention illustrated in the drawings is especially designed as an enclosure for helicopters having two-bladed rotors or rotor blades that can be folded for storage. Thus, the total width of the enclosure need be only slightly greater than the maximum width of the aircraft landing gear, while the length is substantially greater. For a helicopter having a rotor with two non-folding blades, the length of the enclosure must be at least substantially greater than the diameter of the rotor to permit the helicopter to be stored with the rotor blades oriented longitudinally of the enclosure. In an experimental enclosure of the type illustrated and described, the overall length of the structure is 46 feet, with the closed width being only 10 feet. The structure has a height of 11½ feet when closed, and a total width of 31 feet when opened to the position shown in FIGS. 2 and 7. It is apparent, however, that for helicopters having a rotor with more than two blades that cannot be folded, the width of the enclosure would necessarily be somewhat greater. The total width required, over and above that necessary for the body and landing gear for the aircraft, will be determined by the minimum transverse dimension of the stationary rotor, which dimension will vary with the number and length of rotor blades and the ability to motor the rotor to a position presenting its minimum dimension in the transverse direction of the enclosure. Thus, the invention provides for a minimum sized structure which serves both as a landing pad and an enclosure for the aircraft.

This provides a substantial saving in space and enables the location of the enclosure in areas where separage landing and takeoff pad facilities and storage facilities would not be possible.

An important feature of the invention resides in the structure of the end wall assemblies 22 which enable them to be folded down to provide a substantially unobstructed approach and takeoff path at the ends of the enclosure structure. This enables the pilot to fly the aircraft into and out of the structure rather than requiring a straight vertical descent and lift off, thereby substantially facilitating maneuvering the aircraft during landing and takeoff.

In order to accurately position an aircraft on the landing pad to enable the superstructure to be folded to provide the necessary enclosure, a pair of hinged guide plates 76 are mounted one adjacent to each side edge of the floor 56. When the housing is in the open attitude, guide plates 76 are disposed at substantially 45° angles relative to the floor 56, and retained in position by the mounting hinges 78 and angle braces 80. Thus, as a helicopter approaches the landing pad, if the landing gear is not exactly aligned relative to the longitudinal center line of the base 12, the runners of the landing gear will engage one or the other of the guide plates 74 and, as the helicopter is permitted to settle onto the base, plates 74 will act to center the aircraft as the runners slide downwardly along the inclined surface. When the superstructure is then pivoted to the upright or closed position, brace members 30 engage the upwardly inclined edge of the guide plates 76, pivoting them about the hinges 78 so that the guide plates do not interfere with closing of the housing.

While I have disclosed and described a preferred embodiment of my invention, I wish it understood that I do not intend to be restricted solely thereto, but rather that I do intend to include all embodiments thereof which would be apparent to one skilled in the art and which come within the spirit and scope of my invention.

I claim:

1. A combined landing pad and enclosure for a helicopter comprising, an elongated rigid generally rectangular base having a substantially flat horizontal top surface defining a landing and takeoff pad, a housing structure mounted on said base, said housing structure including opposed side walls and opposed end walls extending upwardly from the opposed side and end edges, respectively, of the generally rectangular base, and a roof panel mounted on and supported by said side and end walls, said housing being divided substantially along its longitudinal vertical center plane into two opposed, complementary housing sections each including a segment of said roof panel and of each said end wall, said housing structure having a length at least slightly greater than the diameter of the rotor of a helicopter to be enclosed therein and a width which is substantially less than the diameter of the helicopter rotor when the housing sections are in the closed position, means mounting the respective housing sections for movement about longitudinal, horizontal axes extending one parallel to and adjacent the opposed side edges of said base, said housing sections being moveable between a closed position in which said side walls extend in a generally vertical plane and an open position in which the side walls are pivoted outwardly and downwardly to a substantially horizontal position and said roof panel segments extend generally upward to expose and provide unobstructed access to said landing and takeoff pad and to space the upwardly extending roof panel segments outwardly from said base a distance substantially equal to the full height of said side walls, power means for moving said housing sections between said closed and said open positions, each of said end wall segments comprising a pair of generally triangular panels and means supporting the triangular panels of each said end wall segment for movement relative to one another to reduce the vertical projection of each said end wall segment adjacent said base to a level substantially equal to the level of said base when said housing sections are in the open position.

2. The invention of claim 1 wherein said power means comprises fluid actuated piston and cylinder means connected between said base and said housing section.

3. The invention of claim 1 wherein said end wall segments are generally rectangular and divided along a generally diagonal line extending from a point adjacent the top center of said end wall to the lower outer corner of said end wall when the housing is in the closed position, and wherein said generally triangular panels are hingedly joined along said diagonal line whereby one triangular section may be folded along said hinge to reduce the vertical projection of said end wall segments when the housing sections are in the open position.

4. The invention of claim 3 further comprising releasible latch means for releasibly retaining the triangular panels of each said end wall segment in substantially coplanar relation.

5. The invention of claim 4 wherein one of said generally triangular panels is rigidly joined to the side wall and roof panel of the associated housing section and wherein the other generally triangular panel of each said pair of generally triangular panels is hingedly supported on the rigidly mounted panel for movement between a position in which the two triangular panels are substantially coplanar and a collapsed position in which the moveable triangular panel is pivoted into the interior of the housing.

6. The invention as defined in claim 1 wherein each said end wall segment comprises a first generally triangular panel rigidly joined to and extending between the side wall and roof panel segment of the associated housing section and a second generally triangular panel hingedly mounted on said first triangular panel for movement from a first position substantially coplanar with said first triangular panel and a second, collapsed position folded inwardly into the housing enclosure to thereby reduce the vertical projection of said end wall segments adjacent said base when the housing sections are in the open position.

7. A combined landing pad and enclosure for a helicopter comprising, an elongated rigid generally rectangular base having a substantially flat horizontal top surface defining a landing and takeoff pad, a housing structure mounted on said base, said housing structure including opposed side walls and opposed end walls extending upwardly from the opposed side and end edges, respectively, of said generally rectangular base, and a roof panel mounted on and supported by said side and end walls, said housing being divided substantially along its longitudinal vertical center plane into two opposed, complementary housing sections each including a segment of said roof panel and of each said end wall, each said end wall segment including a first generally triangular panel rigidly joined to and extending between the side wall and roof panel segment of the associated housing section and a second generally triangular panel hingedly mounted on said first triangular panel for movement from a first position substantially coplanar with said first triangular panel and a second, collapsed position folded inwardly into the housing enclosure to thereby reduce the vertical projection of said end wall segments adjacent said base when the housing sections are in the open position, means mounting the respective housing sections for movement about longitudinal, horizontal axes extending one parallel to and adjacent the opposed side edges of said base, said housing sections being movable between a closed position in which said side walls extend in a generally vertical plane and an open position in which the side walls are pivoted outward and downward to a substantially horizontal plane to expose said landing and takeoff pad, power means for moving said housing sections between said closed and said open positions, and door means providing access into the interior of the housing when the housing is in the closed position, said door means being located in and supported for movement with said movable triangular panel.

8. The invention as defined in claim 7 further comprising support legs projecting downwardly from said side walls from a position adjacent said roof when said housing sections are in the open position, said support legs being adapted to engage a support surface to provide vertical support for the housing section in the open position.

* * * * *